US012654093B2

(12) United States Patent
Smith

(10) Patent No.: US 12,654,093 B2
(45) Date of Patent: Jun. 16, 2026

(54) GAME UTILIZING REACTION ADJUSTABLE BUMPER

(71) Applicant: Rodney W Smith, Logan, UT (US)

(72) Inventor: Rodney W Smith, Logan, UT (US)

( * ) Notice: Subject to any disclaimer, the term of this patent is extended or adjusted under 35 U.S.C. 154(b) by 908 days.

(21) Appl. No.: 17/809,541

(22) Filed: Jun. 28, 2022

(65) Prior Publication Data

US 2022/0409988 A1 Dec. 29, 2022

Related U.S. Application Data

(60) Provisional application No. 63/216,439, filed on Jun. 29, 2021.

(51) Int. Cl.
*A63F 7/30* (2006.01)

(52) U.S. Cl.
CPC ..... *A63F 7/30* (2013.01)

(58) Field of Classification Search
CPC .. A63F 7/30; A63F 7/0005; A63F 7/36; A63F 2007/0011; A63F 2007/303; A63F 2007/367
USPC .... 273/108, 109, 110, 111, 113, 115, 118 R, 273/123 R, 127 D
See application file for complete search history.

(56) References Cited

U.S. PATENT DOCUMENTS 2,087,276 A * 7/1937 Becker ..... A63F 7/3075 473/18
2,841,398 A * 7/1958 Conner ..... A63F 7/06 273/127 R
2,992,826 A * 7/1961 Truche ..... A63D 5/02 273/410
3,141,673 A * 7/1964 Scott ..... A63D 15/003 473/32
3,158,373 A * 11/1964 Hastings ..... A63F 7/0017 273/127 R
3,352,558 A * 11/1967 Lucas ..... A63F 7/0628 273/287
3,596,908 A * 8/1971 Long ..... A63F 7/0005 273/129 R
4,046,380 A * 9/1977 Goldfarb ..... A63F 7/0017 273/119 R
4,230,318 A * 10/1980 Dimond ..... A63F 9/02 273/129 R
5,044,639 A * 9/1991 Egging ..... A63F 7/2427 273/342
5,351,960 A * 10/1994 Knapp ..... A63B 69/3676 473/182
5,362,045 A * 11/1994 Hammett ..... A63B 69/0026 273/396
5,516,102 A * 5/1996 Polk, III ..... A63F 7/26 273/119 R
5,833,234 A * 11/1998 Vavala ..... A63B 69/0097 273/400
6,729,964 B2 * 5/2004 Reeves, Jr. ..... A63D 15/02 273/123 R (Continued)

*Primary Examiner* — Joseph B Baldori
(74) *Attorney, Agent, or Firm* — Geoffrey E. Dobbin; Dobbin IP Law, P.C.

(57) ABSTRACT

A game court with improved and adjustable back bumper may feature a back bumper pivotably attached by a band to an interlocking member of the playing court. The bumper may then have a reactive nature to contact by a rolling ball in play. Sliding locks may be utilized to lessen, or even eliminate, the reactive nature of the bumper.

8 Claims, 11 Drawing Sheets

(56) References Cited

U.S. PATENT DOCUMENTS

| | | | | |
|---|---|---|---|---|
| 7,182,704 | B2 * | 2/2007 | Levy | A63B 69/0071 473/433 |
| 8,016,288 | B1 * | 9/2011 | Guridi | A63F 7/0017 273/129 R |
| 8,413,990 | B2 * | 4/2013 | Allshouse | A63B 71/0669 473/438 |
| 8,469,841 | B1 * | 6/2013 | Giauque | A63B 69/0097 473/434 |
| 9,635,935 | B2 * | 5/2017 | Guridi | A63F 7/00 |
| 10,076,695 | B1 * | 9/2018 | Simon | A63B 69/0026 |
| 2018/0229141 | A1 * | 8/2018 | Miller | A63F 3/00097 |
| 2019/0184271 | A1 * | 6/2019 | Corbitt, IV | A63F 7/0005 |
| 2023/0125772 | A1 * | 4/2023 | McDonough | A63F 7/2427 273/119 R |

* cited by examiner

GAME UTILIZING REACTION ADJUSTABLE BUMPER

CROSS-REFERENCES TO RELATED APPLICATIONS

The present invention claims priority as a non-provisional perfection of prior filed U.S. Application No. 63/216,439, filed on Jun. 29, 2021, and incorporates the same by reference herein in its entirety.

FIELD OF THE INVENTION

The present invention relates to the field of games and diversions and more particularly relates to a rolling ball game utilizing a back bumper with adjustable reactionary properties.

BACKGROUND OF THE INVENTION

Games have been part of human culture from time immemorial. While rules may change, some basic types of games persist. One type of game utilizes the rolling of balls towards some form of target, whether the game simply involves rolling a ball towards a previously rolled target ball, like bocce, or a through a circuit, like croquet. The basic premise of these games involves a court or course, some form of rules regarding the moving of the balls, and some form of valuing the resultant roll, usually by proximity or placement by or in a target area. A game may utilize a court that is bounded by some form of walls or bumpers that would keep any rolled balls on said court. Much like billiards, then, the walls or bumpers may be utilized strategically to move a ball or balls towards an intended target. A bumper that can have a reaction that is adjustable may then alter game play. The present invention is a rolling ball-type skill game utilizing a bumper with an adjustable reaction to alter game play and effects. The present invention represents a departure from the prior art in that the adjustable bumper of the present invention allows for simple modification of game play mechanics with a simply constructed bumper and stop assembly.

SUMMARY OF THE INVENTION

In view of the foregoing disadvantages inherent in the known types of play bumpers, an improved bumper may provide a skill game that meets the following objectives: that it is simple to install, features a tension adjustable elastomeric control, and that it has a plurality of stop with which to arrest reaction should it be desired to do so. As such, a new and improved bumper may comprise and elongate wall secured to a court by a single and centrally located band, which may or may not be elastomeric, and held in position by optionally deployed sliding blocks with which to arrest movement of said bumper to accomplish these objectives.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

In order to better describe the manner in which the above-recited and other advantages and features of the invention can be obtained, a more particular description of the invention that was briefly described above will be rendered by reference to specific example embodiments thereof which are illustrated in the appended drawings. Understanding that these drawings depict only typical embodiments of the invention and are therefore not to be considered as limiting of its scope, the invention will be described and explained with additional specificity and detail using the accompanying drawings.

DETAILED DESCRIPTION OF THE PREFERRED EMBODIMENT

With reference now to the drawings, a preferred embodiment of the game utilizing the adjustable bumper is herein described. It should be noted that the articles "a", "an", and "the", as used in this specification, include plural referents unless the content clearly dictates otherwise.

Figure 1:
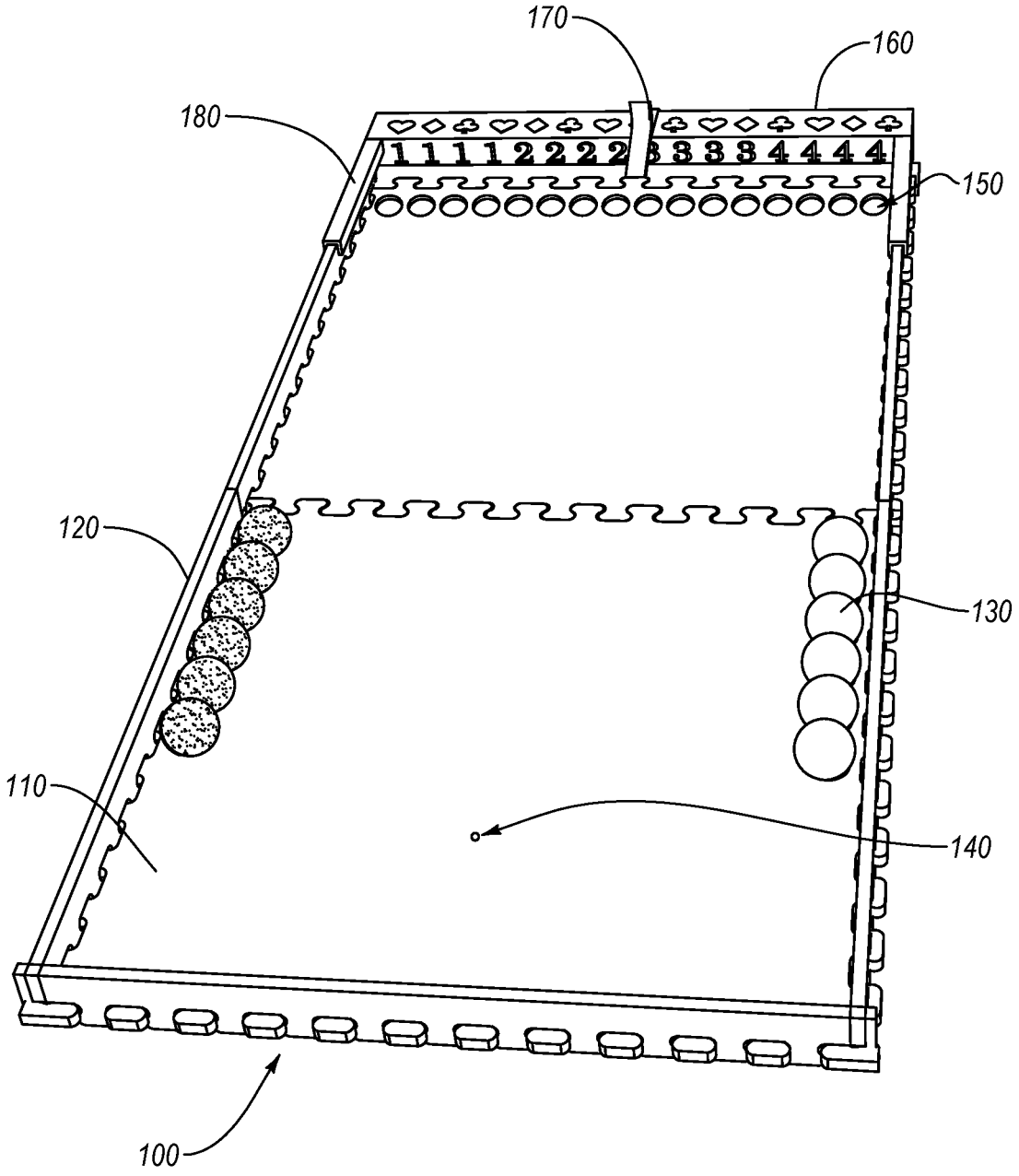
FIG. 1 is a perspective view of a court for use with rolling-ball game.
Figure 2:
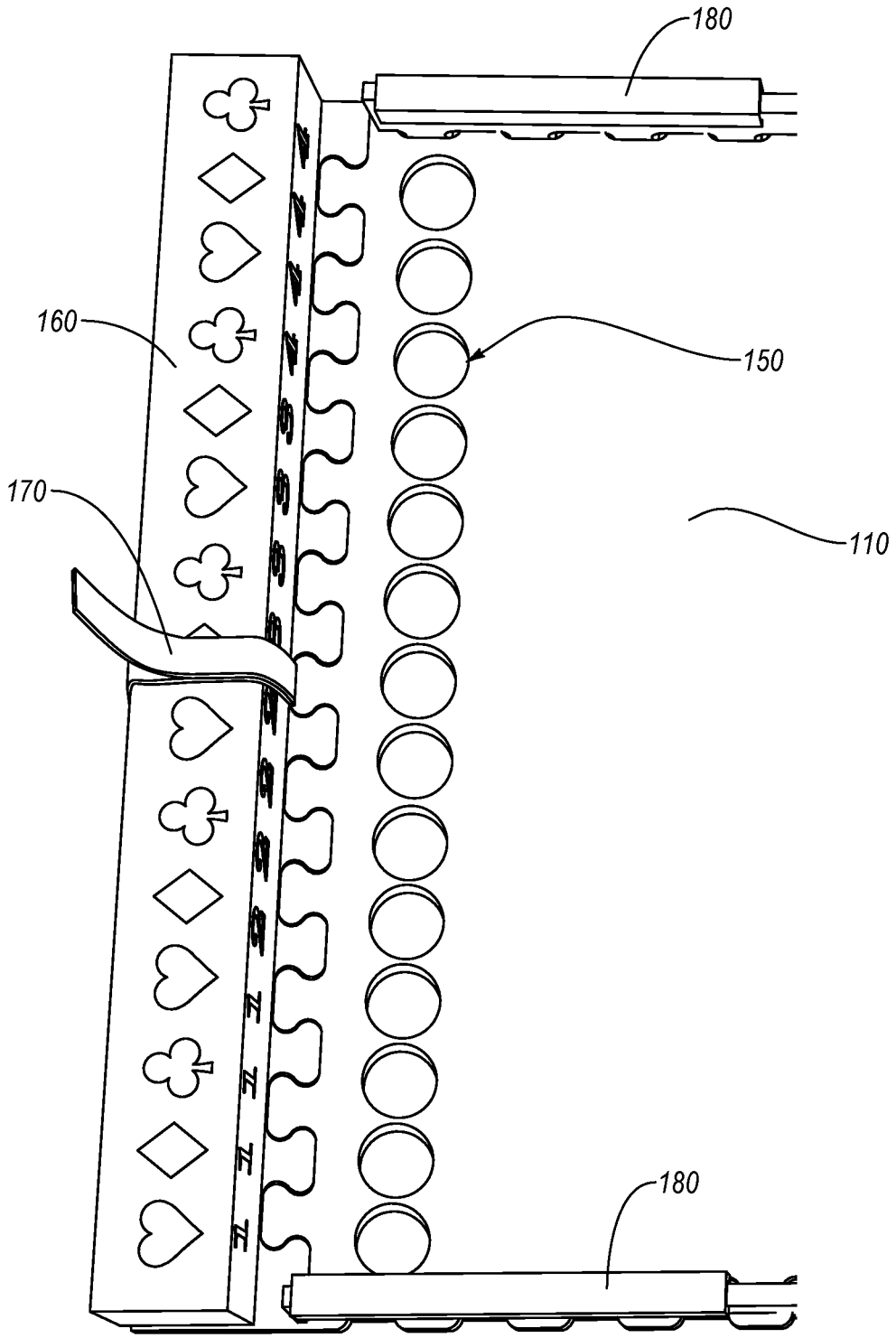
FIG. 2 is a perspective view of the target end of the court of FIG. 1.

With reference to FIG. 1, a court 100 has a bottom surface 110 and a plurality of side walls 120 situated on the edge thereon. A plurality of balls 130 are positioned on or by the court 100 for play. The court may have a start position marketed by a hole 140 in which a ball 130 may be positioned (FIG. 3) for launch. The goal is to position as many balls 130 as possible in target holes 150 (FIGS. 1 and 2) in a targeting zone opposite the start position 140. A bumper 160 resides at the edge of the court 100 proximate the target holes 150 and is secured to the bottom surface 110 with a band 170. Band 170 may be elastomeric or may alternately be an adjustable hook-and-loop strap, which is preferred. Target holes 150 may be assigned values based upon indicia placed upon the back bumper 160. Different indicia may be positioned upon or within the bumper 160 for different games, with selection made by rotating the bumper 160 within the band 170. It is possible to also make additional sets of scoring indicia which may be positioned within a hollow bumper depending on a desired game. In this way, a user may generate and use as many sets of indicia as may be desired and not be limited to the number of sides of the bumper.

Ideally, the bottom surface 110 and side bumpers 120 are made of interlocking foam squares or strips, such as those used in padding floors. This provides a readily assembled and disassembled playing surface and secures the court pieces in a relatively rigid fashion. The back bumper 160 is not interlocked with the playing court 100 but is only held on position by the band 170, which is looped around the bumper 160 and a thin strip of the court material 190 (FIG. 5) which does interlock with the bottom surface 110. This then secures the back bumper 160 to the game court 100 at a single point, allowing the bumper 160 to pivot about the band 170. The band 170 ideally wraps around the back bumper 160 and the strip 190 at the seam at which the thin strip 190 interlocks with the bottom surface 110.

Figure 3:
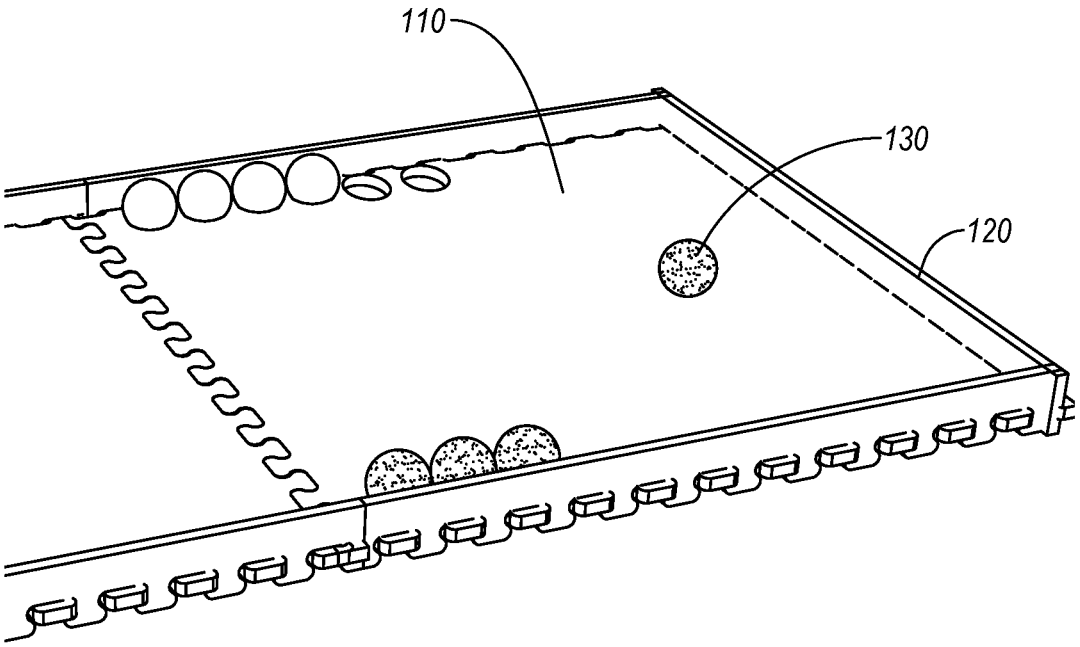
FIG. 3 is a perspective view of the launch end of the court of FIG. 1, with a ball in position for launch.
Figure 4:
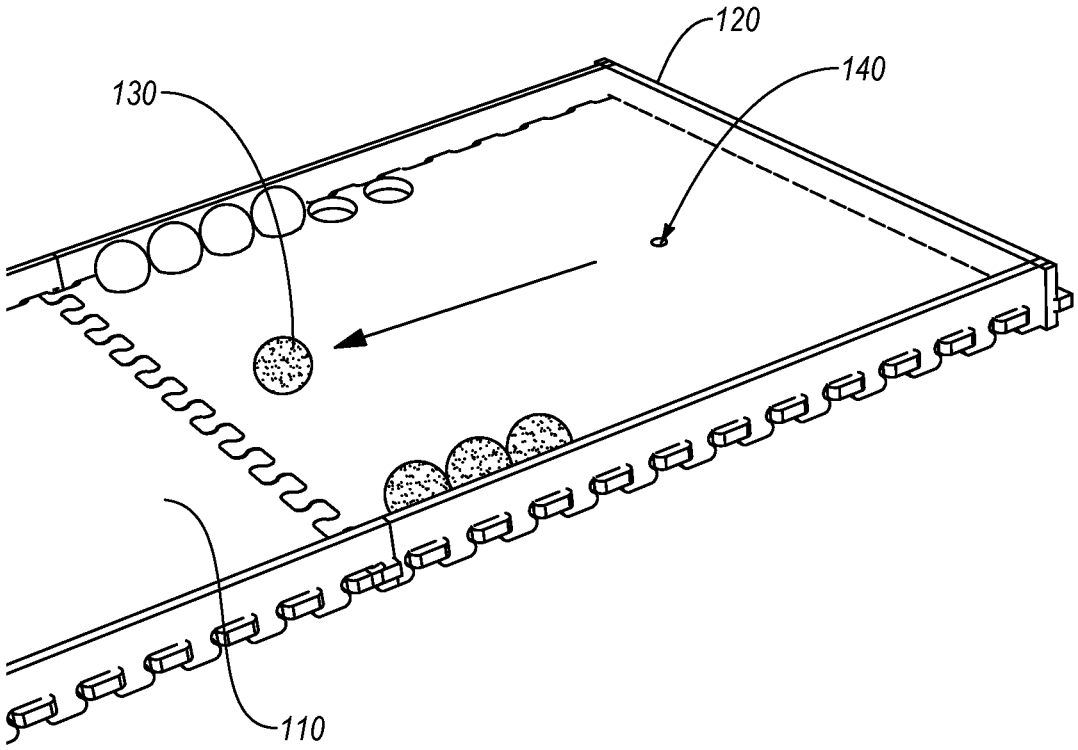
FIG. 4 is a perspective view of the launch end of the court of FIG. 3, the ball having been launched.
Figure 5:
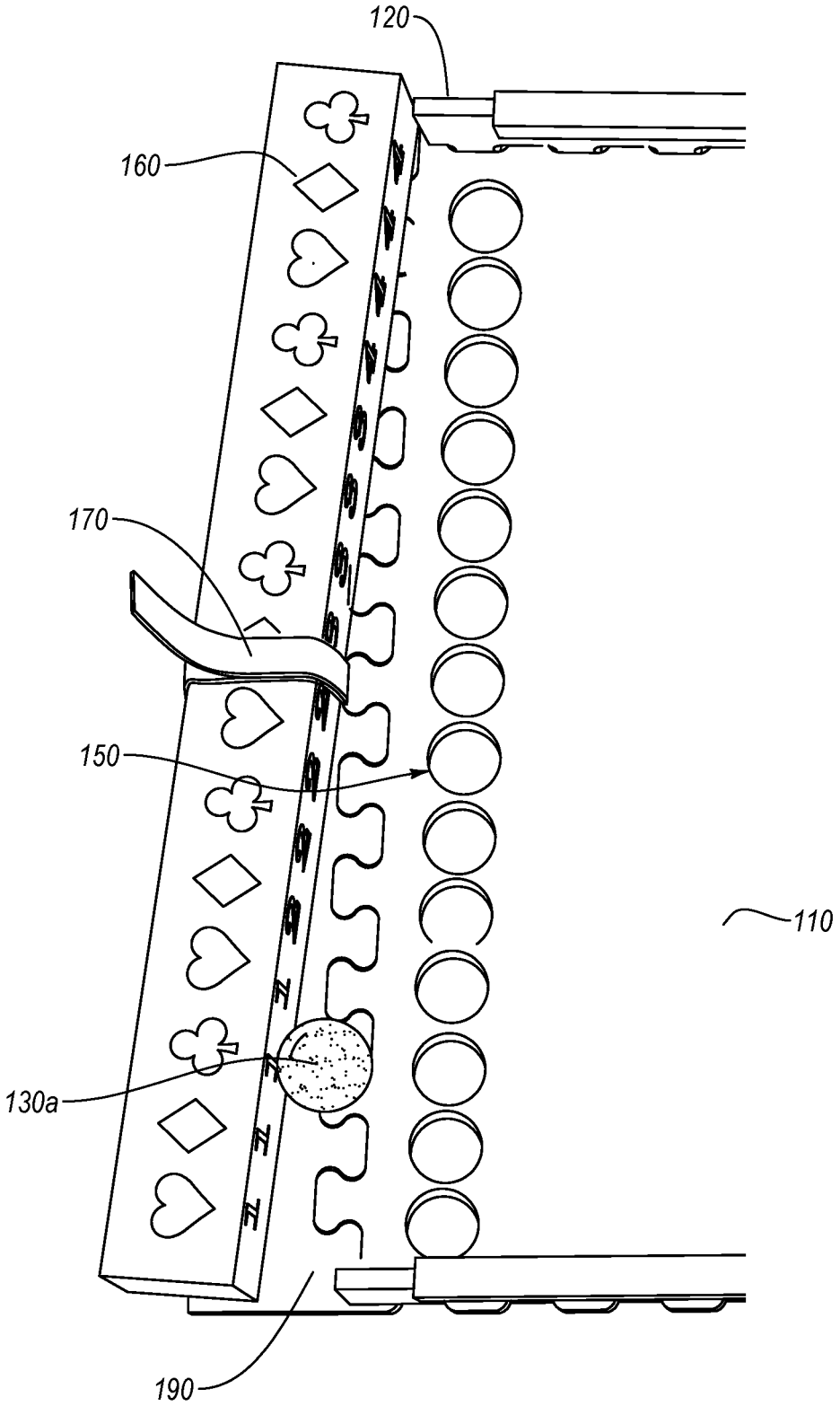
FIG. 5 is a perspective view of the target end of the court of FIG. 4, the ball having settled proximate said bumper.
Figure 6:
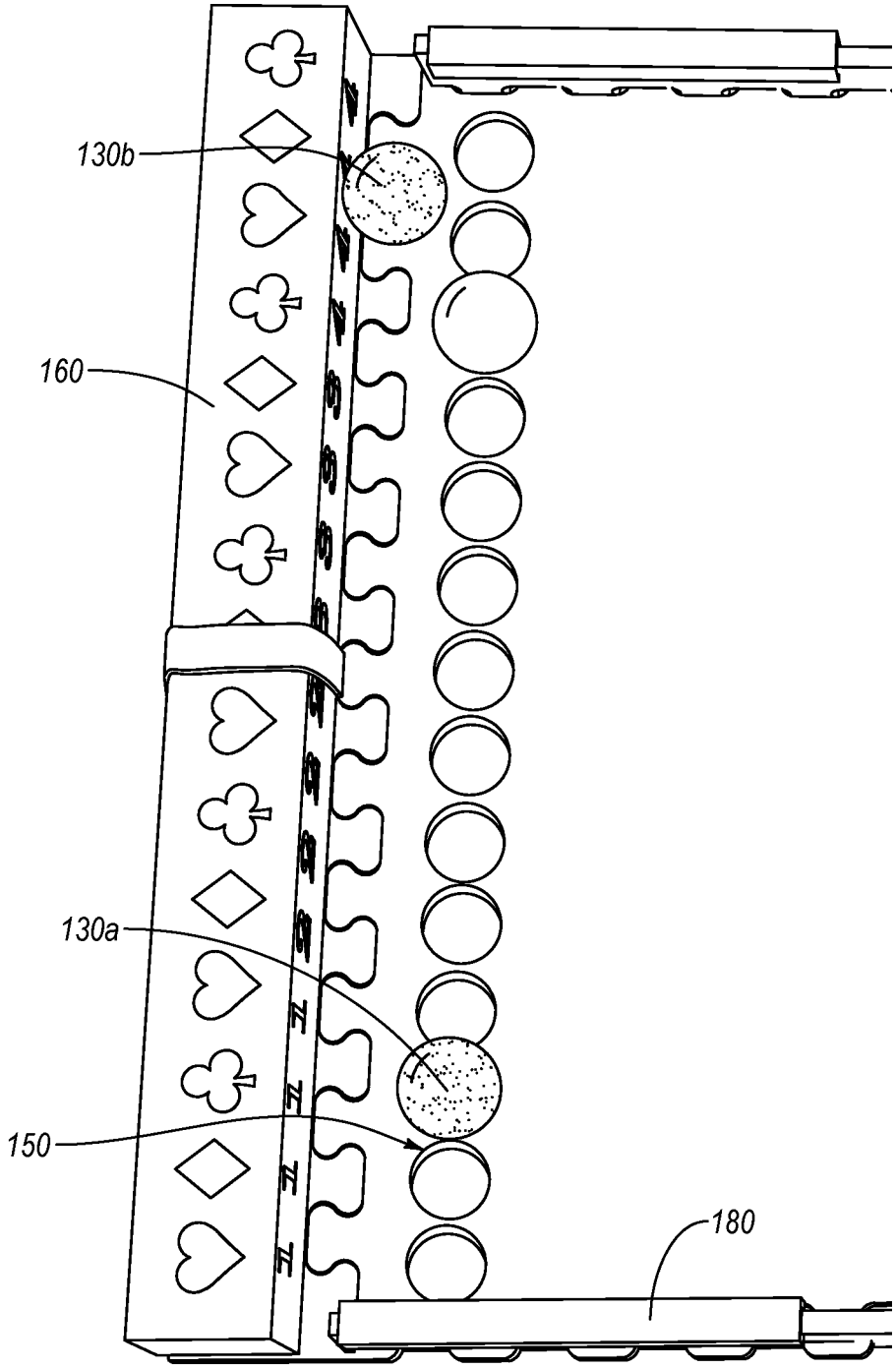
FIG. 6 is a perspective view of the target end of the court of FIG. 5, after more balls have been played.

In play, a ball 130 is positioned in the launch hole 140 and propelled towards the target holes 150 (FIGS. 3-5). This may be accomplished by any means but may simply be done propelling the ball with a finger, or other tool, or by lifting the playing court 100 in a manner that gravity frees the ball 130 from launch hole 140 (FIG. 4). Should the ball 130*a* not land in a target hole 150, it strikes the back bumper 160, which keeps the ball 130*a* in play (FIG. 5). The back bumper 160 will react to the impact by moving slightly but will generally pivot about the band 170. This action tends to make the back bumper 160 askew in relation to the court 100. What may then be done is that a second ball 130*b* may be launched towards the back bumper 160 with the intent to bat the first ball 130*a* into a target hole 150. (FIG. 6). Scoring may then be tabulated after all balls 130 have been placed in play and based upon whatever methodology is desired.

Figure 7:
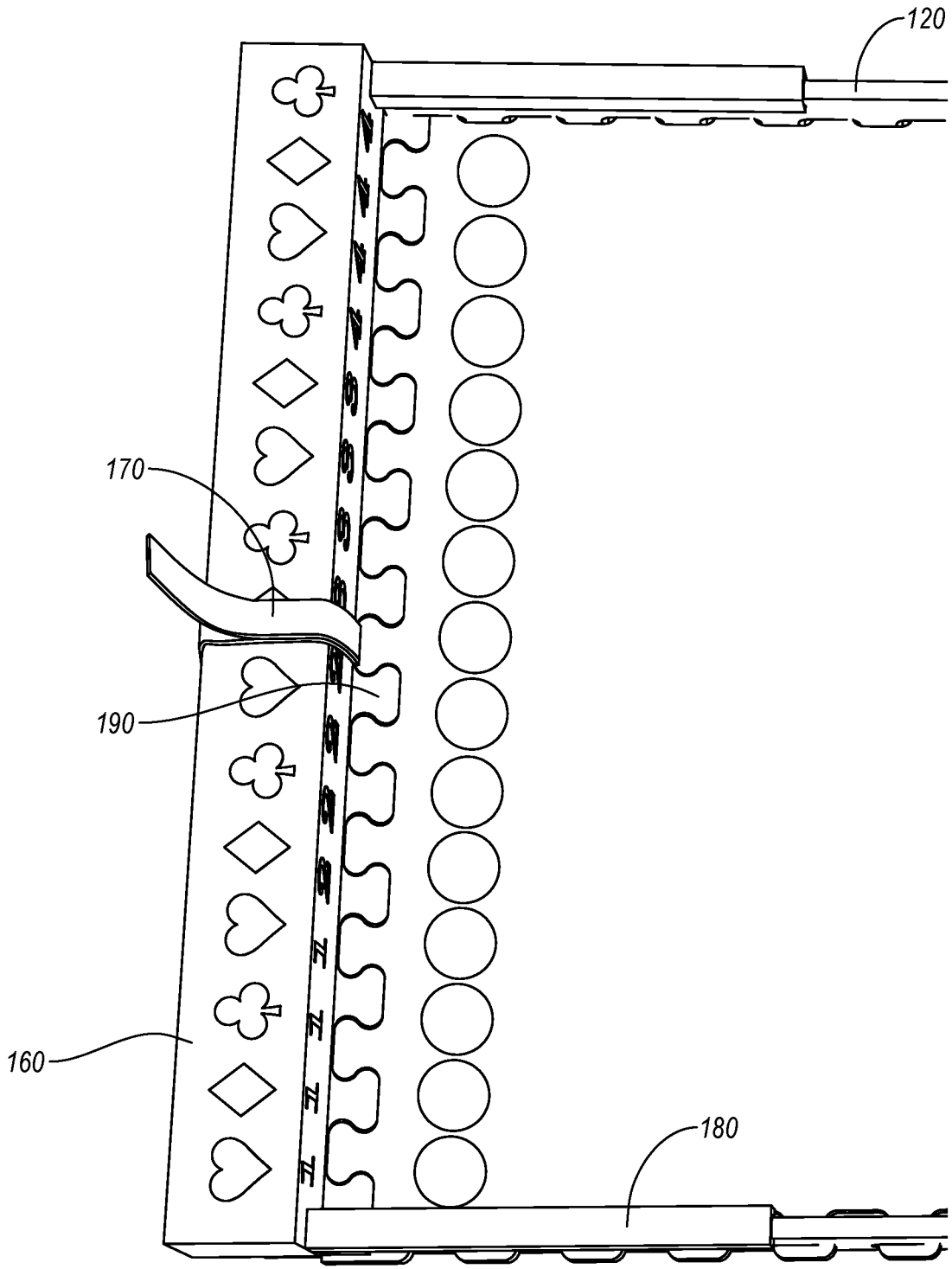
FIG. 7 is a perspective view of the target end of the court of FIG. 2, having slidable blocks arrest said bumper's movement.
Figure 8:
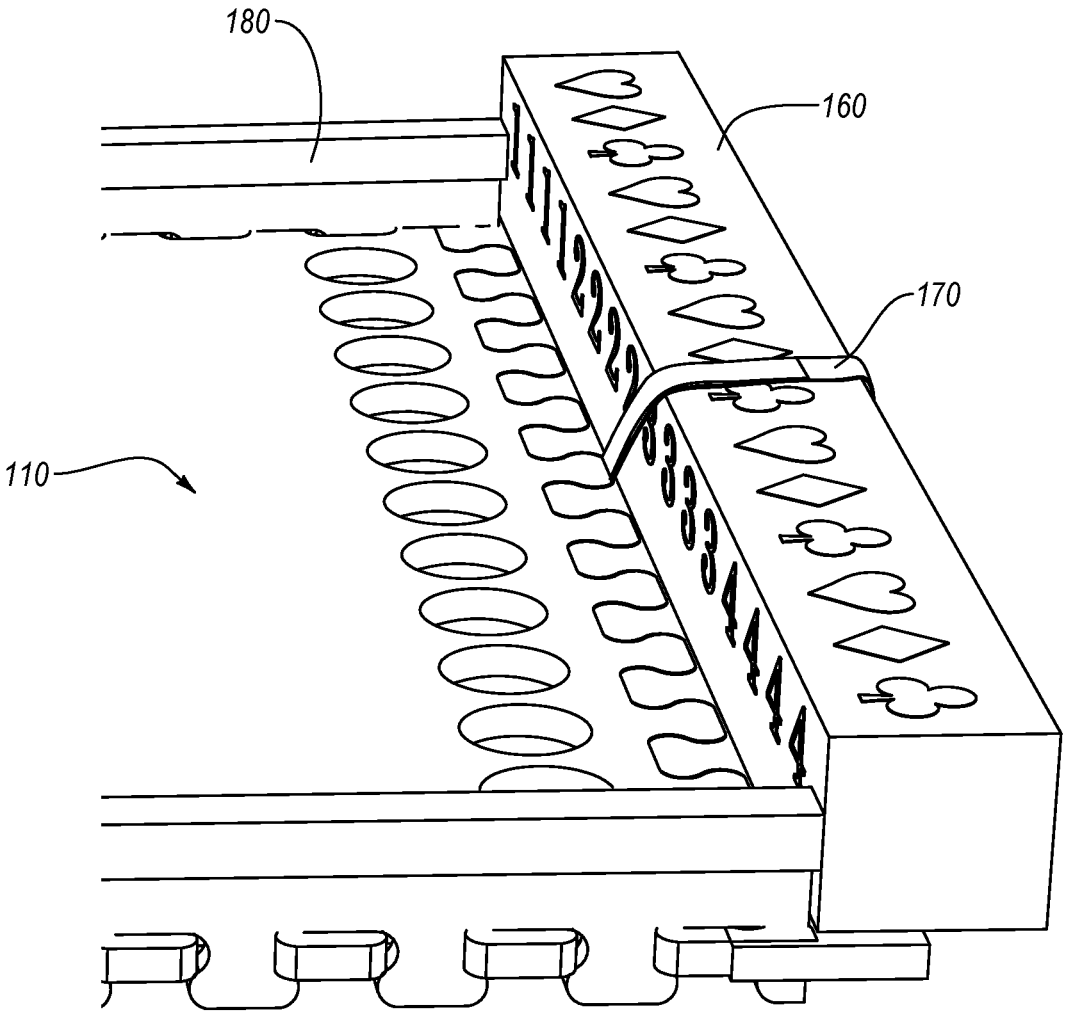
FIG. 8 is an alternate perspective view of the target end of the court of FIG. 7.
Figure 9:
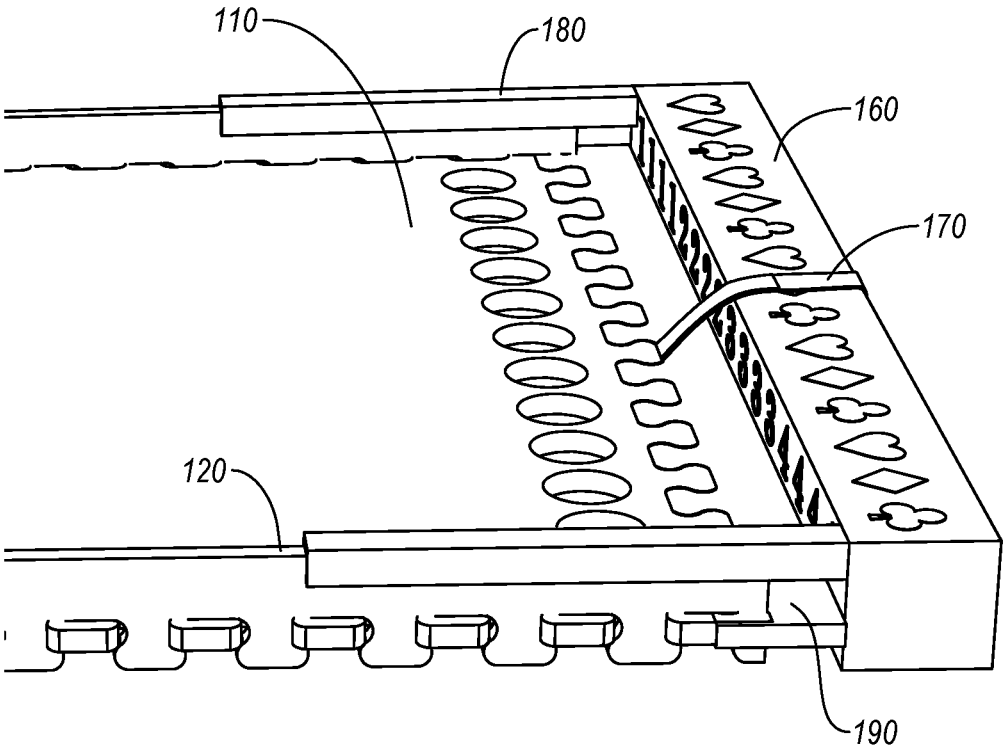
FIG. 9 is an alternate set-up of the target end of the court of FIG. 2.
Figure 10:
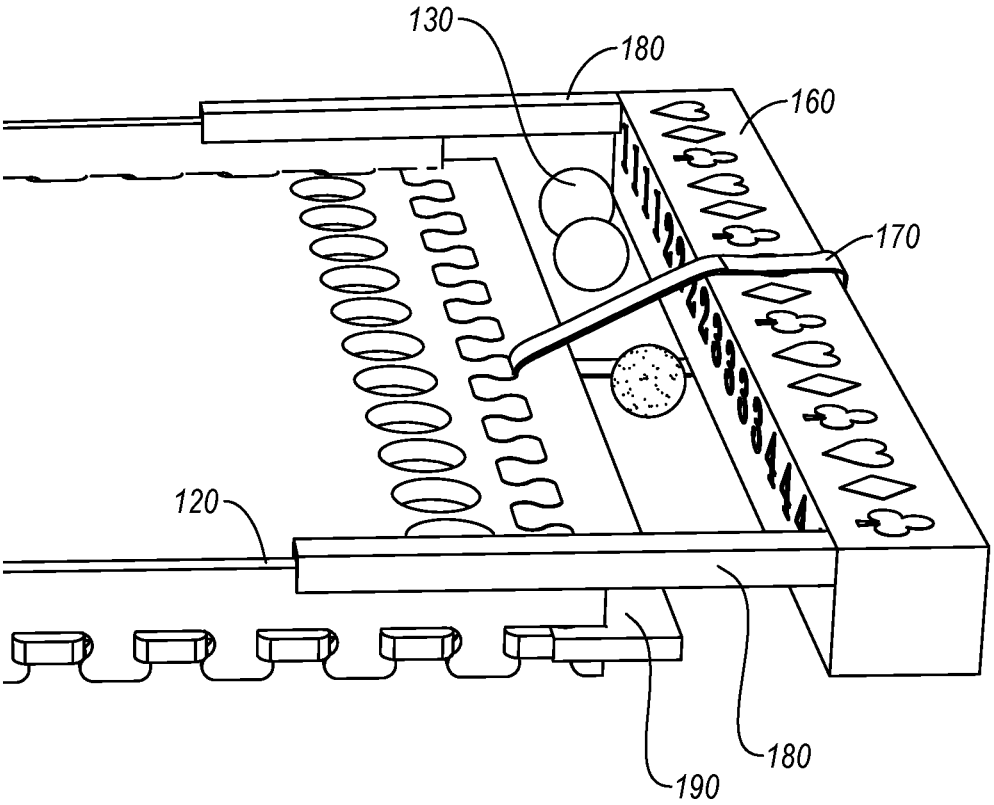
FIG. 10 is another alternate set-up of the target end of the court of FIG. 2

One option would be to reduce or eliminate the reactive nature of the back bumper 160. This may be accomplished by maneuvering sliding blocks 180, located on side walls 120 (FIGS. 6-10). These blocks 180 serve to secure the ends of back bumper 160 and lessen the reactive forces of band 170. The extent to which the blocks are extended into the back bumper 160 eliminates the available play with which the bumper 160 may move. If the band is elastic, the blocks 180 stretch the band 170 to varying extents, even to the point of virtually eliminating its reactive force. Blocks 180 should secure themselves to the side walls 120 in a manner that will resist the elastic and restorative force of the elastic band 170 as this elastic force increases as the band is stretched ($-kx$, where k is the spring constant and x is the displacement of the band). Another option is to vary the strength and/or number of elastic bands, or to position the band 170 in a location other than the center of the game court 100. For a non-elastic band, the length of the band 170 may be adjusted to accommodate either more or less reaction. It should be noted that FIG. 6 depicts a fully reactive bumper 160, with space between the side walls 120 and the edges of bumper 160. FIGS. 7 and 8 depict a configuration with no reaction available, as bumper abuts sides walls 120. FIG. 9 depicts an alternate embodiment where the back bumper 160 is positioned away from the ends of the side walls, off the end strip 190. This configuration increases the space in which a ball may move out of play. The depicted configuration has two points of contact between each end of the bumper 160 and the remaining portion of the playing court, the end strip 190 and blocks 180. It also should be noted that the strap 170 is adjusted to accommodate for the bumper position. It should be readily understood that a smaller area could be configured by placing the bumper back on the end strip 190 and adjusting the strap 170 accordingly. An elastic strap 170 would require the blocked configuration if the length and elasticity of the strap were not planned out. FIG. 10 shows an alternate configuration where the strap 170 and blocks 180 are adjusted to create a drop-off that renders overshot balls 130 totally out of play.

Figure 11:
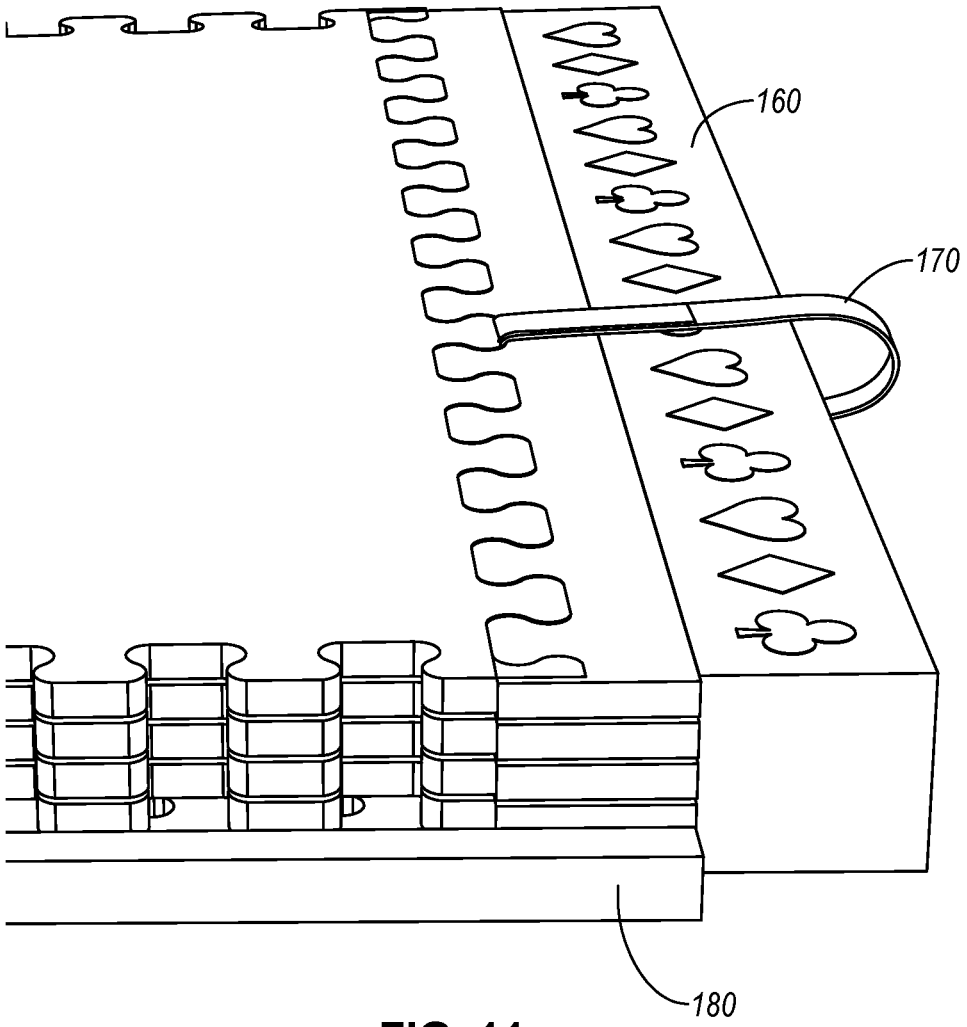
FIG. 11 is a perspective view of the court of FIG. 1, in a stowing configuration.

The game court may be stowed (FIG. 11) by simply disassembling the foam components and interlocking strip and wall components to the game surface squares. Then the components are stacked and the strap 170 is threaded through the ends of each component and around the bumper 160, like the game setup. A non-elastic band 170 made of hook-and-loop material could be configured into a handle for the game. It should be noted that four layers of foam padding are shown in FIG. 11. The game court may be made to any length practicable by adding or subtracting the court components. As such, the game could be a tabletop or floor game, depending on the needs and desires of the user.

Although the present invention has been described with reference to preferred embodiments, numerous modifications and variations can be made and still the result will come within the scope of the invention. The described embodiments are to be considered in all respects only as illustrative and not restrictive. No limitation with respect to the specific embodiments disclosed herein is intended or should be inferred. Therefore, the scope of the invention is indicated by the appended claims rather than by the foregoing description. All changes which come within the meaning and range of equivalency of the claims are to be embraced within their scope.

What is claimed is:

1. A game court comprising a flat rolling surface bounded by opposed side walls;

a far wall, adjacent a targeting zone, being a bumper attached to the rolling surface by a single pivot point; and two sliding blocks, mounted upon the opposed side walls, which may be selectively positioned against the bumper to arrest movement of said bumper relative the rolling surface.

2. The game court of claim 1, the two sliding blocks being slidably engaged on a side wall such the two sliding blocks may be slid along the side walls into a position to abut the bumper.

3. The game court of claim 1, the bumper being attached to the rolling surface by a band.

4. The game court of claim 3, the band being an elastomeric band.

5. The game court of claim 3, the band being a hook-and-loop strap of adjustable length.

6. The game court of claim 1, the rolling surface and at least one wall being constructed of interlocking foam pads.

7. The game court of claim 1, the bumper having a plurality of sets of scoring indicia denoted thereon, each set of scoring indicia being located on a discrete side of the bumper apart from other sets of scoring indicia.

8. The game court of claim 1, the bumper being hollow and capable of receiving chosen indicia dependent upon a desired game.

* * * * *